US008020222B2

(12) United States Patent
Falcon et al.

(10) Patent No.: US 8,020,222 B2
(45) **Date of Patent: *Sep. 20, 2011**

(54) BAG DISPENSING RECEPTACLE FOR PLUNGING APPARATUS

(76) Inventors: Michael David Falcon, Austin, TX (US); Ernest William Falcon, Allen, TX (US)

( * ) Notice: Subject to any disclaimer, the term of this patent is extended or adjusted under 35 U.S.C. 154(b) by 709 days.

This patent is subject to a terminal disclaimer.

(21) Appl. No.: 12/156,017

(22) Filed: May 28, 2008

(65) Prior Publication Data

US 2009/0293184 A1 Dec. 3, 2009

(51) Int. Cl.
*E03D 9/00* (2006.01)

(52) U.S. Cl. ..... 4/255.11; 4/255.01

(58) Field of Classification Search ..... 4/255.11, 4/255.12, 255.03, 255.01, 255.02, 255.04, 4/255.05, 255.06, 255.07, 255.08, 255.09
See application file for complete search history.

(56) References Cited

U.S. PATENT DOCUMENTS

| | | | | |
|---|---|---|---|---|
| 2,668,974 | A * | 2/1954 | Jaeger | 15/210.1 |
| 6,094,771 | A * | 8/2000 | Egolf et al. | 15/210.1 |
| 6,192,525 | B1 | 2/2001 | Tash | |
| 6,434,760 | B1 * | 8/2002 | Montalvo | 4/255.05 |
| 6,622,316 | B1 * | 9/2003 | Brown | 4/255.11 |
| 6,701,540 | B1 * | 3/2004 | Gabriel | 4/255.11 |
| 7,124,450 | B2 | 10/2006 | Davidson | |
| 7,281,278 | B1 | 10/2007 | Biagi et al. | |
| 7,523,510 | B1 * | 4/2009 | Biagi et al. | 4/255.11 |
| 7,908,681 | B2 * | 3/2011 | Nguyen et al. | 4/255.02 |
| 2004/0090073 | A1 | 5/2004 | Edwards | |
| 2005/0127087 | A1 | 6/2005 | Clark | |
| 2007/0089224 | A1 * | 4/2007 | Wildauer et al. | 4/255.11 |
| 2007/0143909 | A1 * | 6/2007 | Montgomery | 4/213 |
| 2009/0049593 | A1 * | 2/2009 | Hodkiewicz | 4/255.05 |
| 2009/0070924 | A1 * | 3/2009 | Montgomery | 4/347 |
| 2009/0106887 | A1 * | 4/2009 | Dressel | 4/255.11 |
| 2009/0293185 | A1 * | 12/2009 | Falcon et al. | 4/255.11 |
| 2011/0010832 | A1 * | 1/2011 | Tsiros | 4/255.11 |

* cited by examiner

*Primary Examiner* — Brian Glessner
*Assistant Examiner* — Rodney Mintz

(57) ABSTRACT

The field of the invention relates generally to a plunging system including, inter alia, a plunger having a handle and a plunger member, the handle having first and second opposed ends with the plunger member being removably coupled to the second end of the handle; and a receptacle, having a top portion coupled to a body portion, the body portion including first and second recesses defining first and second support regions, the first support region cincturing the first recess and second support region cincturing the first support region and the first and second recesses, with a segment of the top portion in superimposition with the second recess defining a chamber, with the receptacle being coupled to the first end of the handle such that the handle is positioned within the first recess, with the chamber comprising a plurality of bags positioned therein that may be dispensed from the receptacle.

17 Claims, 4 Drawing Sheets

BAG DISPENSING RECEPTACLE FOR PLUNGING APPARATUS

TECHNICAL FIELD

The field of the invention relates generally to a plunging apparatus.

BACKGROUND INFORMATION

The most common tool used in unplugging a fixture is a plunger, wherein the fixture may include, but not limited to, a toilet, sink, or bathtub. Such plungers typically have an elongated wooden handle with a rubber force cup mounted on one end thereof. In use, the rubber force cup is inserted into the fixture and into covering contact with the bowl outlet. During use the force cup and adjacent handle portion are exposed to the unsanitary material in the fixture bowl. After use the force cup and adjacent handle portion may comprise unsanitary material positioned thereon.

Previous attempts of a plunging apparatus to facilitate managing the unsanitary material is disclosed in U.S. Pat. No. 7,124,450 to Davidson. Davidson describes a flushable cover for a plunger with a layer of a flushable paper material and a layer of a film soluble in cold water. The cover is constructed to maintain integrity during use of the plunger, but at the same time being capable of being broken down in water.

What is desired, however, is an improved plunging apparatus to manage the unsanitary material thereon.

SUMMARY

The field of the invention relates generally to a plunging system including, inter alia, a plunger having a handle and a plunger member, the handle having first and second opposed ends with the plunger member being removably coupled to the second end of the handle; and a receptacle, having a top portion coupled to a body portion, the body portion including first and second recesses defining first and second support regions, the first support region cincturing the first recess and second support region cincturing the first support region and the first and second recesses, with a segment of the top portion in superimposition with the second recess defining a chamber, with the receptacle being coupled to the first end of the handle such that the handle is positioned within the first recess, with the chamber comprising a plurality of bags positioned therein that may be dispensed from the receptacle.

DETAILED DESCRIPTION

Figure 1:
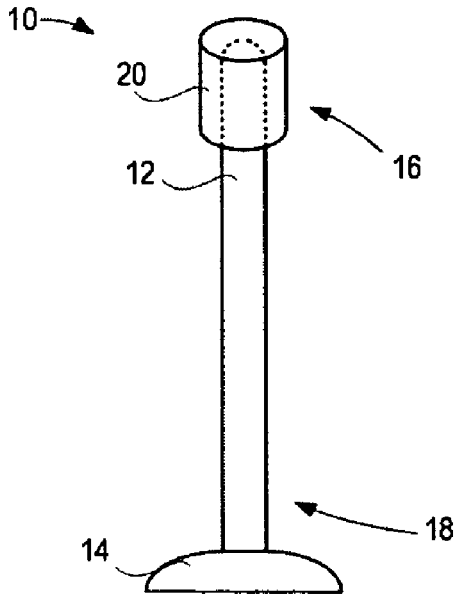
FIG. 1 is a perspective view of a plunging apparatus having a receptacle coupled thereon, in a first embodiment of the present invention.

Referring to FIG. 1, a plunging apparatus 10 is shown. Plunging apparatus 10 comprises a handle 12 and a plunger member 14. Handle 12 comprises first and second opposed ends 16 and 18. Handle 12 may have a cylindrical shape, however, handle 12 may comprise any geometric shape desired. Plunger member 14 may be removably coupled to second end 18 of handle 12.

Figure 2:
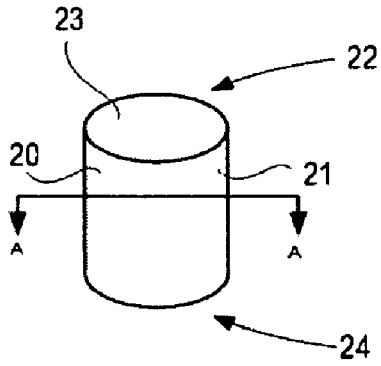
FIG. 2 is a perspective view of the receptacle shown in FIG. 1.
Figure 3:
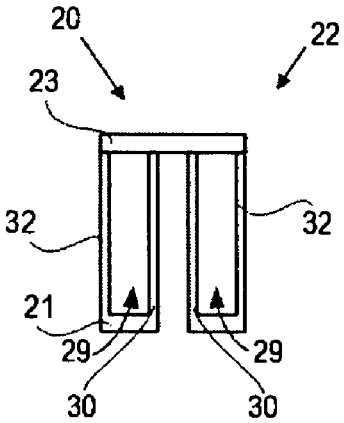
FIG. 3 is a cross-sectional view of the receptacle shown in FIG. 2, having a top portion coupled to a body portion.
Figure 4:
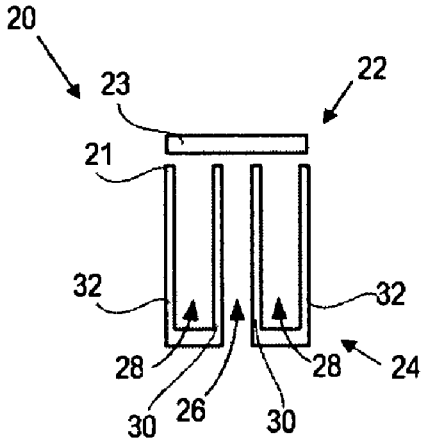
FIG. 4 is a cross-sectional view of the receptacle shown in FIG. 2, having a top portion separated from a body portion.

Referring to FIGS. 1, 2, and 3, plunging apparatus 10 further comprises a receptacle 20. A cross-section of receptacle 20 is shown along lines A-A' in FIG. 3. Receptacle 20 may comprise any material including, but not limited to, plastic, cardboard, or similar construction. Receptacle 20 comprises a body portion 21 and a top portion 23. Top portion 23 may be coupled to body portion 21; however, top portion 23 may be removable from body portion 21, as shown in FIG. 4.

Receptacle 20 may have first and second opposed sides 22 and 24. First side 22 of receptacle 20 may comprise a first recess 26 and a second recess 28, spaced-apart from first recess 26, defining first 30 and second 32 spaced-apart support regions. First support region 30 cinctures first recess 26 and second support region 32 cinctures first support region 30 and first and second recesses 26 and 28. To that end, upon portion 23 being coupled to body portion 21, as shown in FIG. 3, second recess 28 and a segment of top portion 23 in superimposition therewith define a chamber 29. As shown, receptacle 20 comprises a cylindrical shape, however, in a further embodiment, receptacle 20 may comprise any geometric shape as desired.

Receptacle 20 may be coupled to first end 16 of handle 12. More specifically, first end 16 of handle 12 may be positioned within first recess 26 of receptacle 20. Receptacle 20 may be coupled to handle 12 via an adhesive including, but not limited to, glue, tape, and VELCRO® hook and loop fastener. Receptacle 20 may be permanently, semi-permanently, or temporarily coupled to handle 12, depending on the type of application desired. Further, first recess 26 of receptacle 20 may have a variable diameter such that differing diameters associated with first end 16 of handle 12 may be positioned therein.

Figure 5:
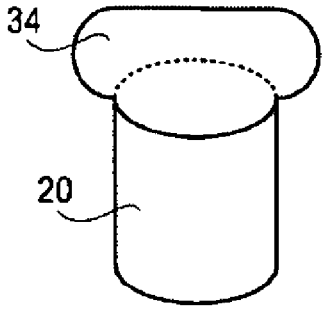
FIG. 5 is a perspective view of the receptacle shown in FIG. 2, having a bulbous portion thereon.
Figure 6:
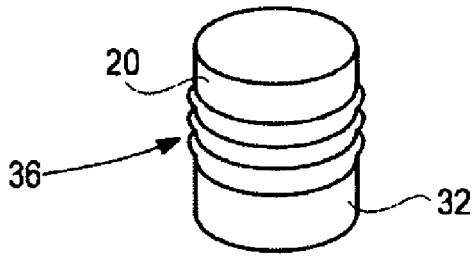
FIG. 6 is a perspective view of the receptacle shown in FIG. 2, having a grip positioned thereon.

Referring to FIGS. 2 and 5, in a further embodiment, receptacle 20 may comprise a bulbous portion 34 coupled to first side 22. Bulbous portion 34 may facilitate the plunging process employing plunging apparatus 10 by providing a place for positioning the user's hand or palm of hand to provide comfort. Bulbous portion 34 may comprise a pad or an ergonomic design. Referring to FIG. 6, in still a further embodiment, receptacle 20 may comprise a grip 36 positioned on second support region 32. Grip 36 may facilitate the plunging process employing plunging apparatus 10 by providing a non-slip hand grip for the user's hands.

Figure 7:
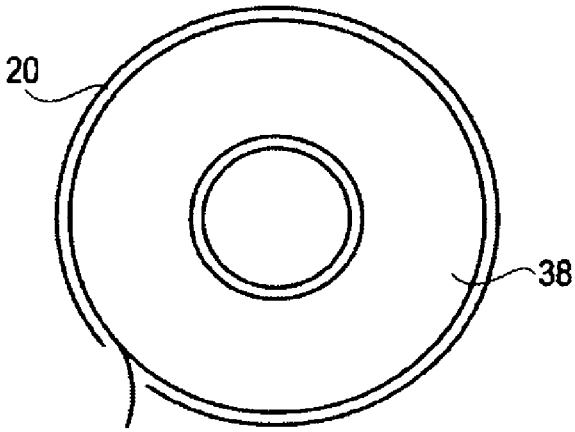
FIG. 7 is a top-down view of the receptacle shown in FIG. 2, the receptacle having a plurality of bags positioned therein.
Figure 8:
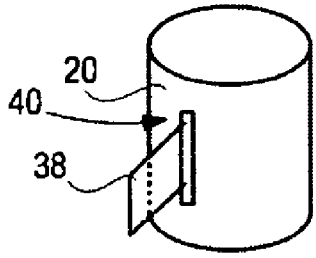
FIG. 8 is a perspective view of the receptacle shown in FIG. 2, the receptacle having a bag egressing therefrom.

Referring to FIGS. 3, 7 and 8, receptacle 20 may comprise a plurality of bags 38 positioned therein. More specifically, bags 38 may be positioned within chamber 29 of receptacle 20. Bags 38 may be dispensed from receptacle 20 via a throughway 40. More specifically, in an embodiment, each bag of bags 38 may be coupled to an adjacent bag of bags 38. In an example, each bag of bags 38 may be coupled to an adjacent bag of bags 38 via perforations. Further, each bag of bags 38 may be coupled to an adjacent of bag of bags 38 such that once a bag of bags 38 is removed, an adjacent bag of bags 38 may be partially egressed from receptacle 20. Furthermore, upon utilizing bags 38 within receptacle 20, described further below, additional bags 38 may be positioned within receptacle 20 via removing top portion 23, as described above.

Figure 9:
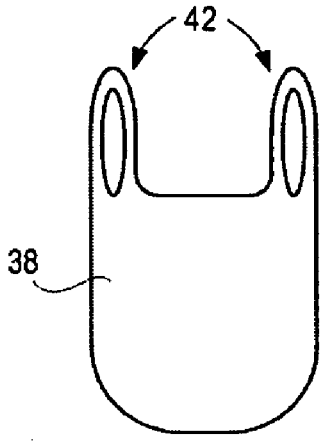
FIG. 9 is a perspective view of the bag shown in FIG. 8 having handles.

Bags 38 may comprise materials including, but not limited to, plastic, a waterproof material, or a material that may be disposable in any standard trash receptacle. In a further embodiment, bags 38 may be scented, deodorized, sanitized absorbent, or a combination thereof. In still a further embodiment, bags 38 may comprise a handle 42, as shown in FIG. 9.

To that end, after employing plunging apparatus 10 on a fixture, plunging apparatus 10 may comprise unsanitary material positioned thereon, which may be undesirable. Further, after removing plunging apparatus 10 from the fixture may result in contaminated water dripping from the plunging apparatus 10 to the floor, which is undesirable. To that end, bags 38 positioned within receptacle 20 may be employed to minimize, if not prevent, water dripping from plunging apparatus 10 to the floor.

Figure 10:
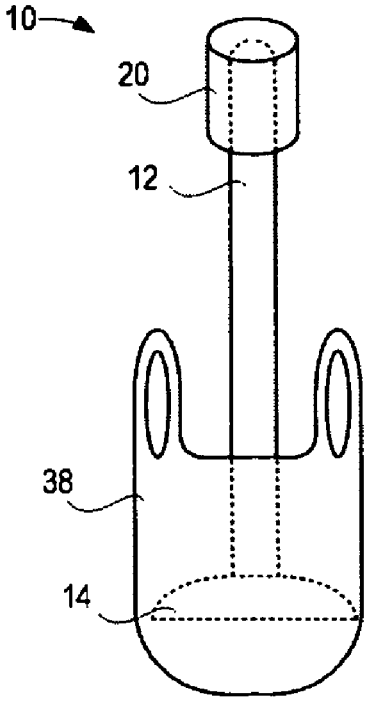
FIG. 10 is a perspective view of the plunging apparatus shown in FIG. 1 positioned within the bag shown in FIG. 9.
Figure 11:
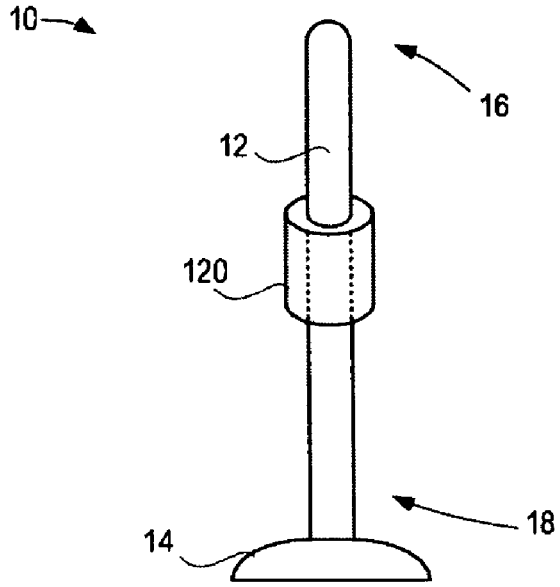
FIG. 11 is a perspective view of the plunging apparatus having a receptacle coupled thereon, in a second embodiment of the present invention.
Figure 12:
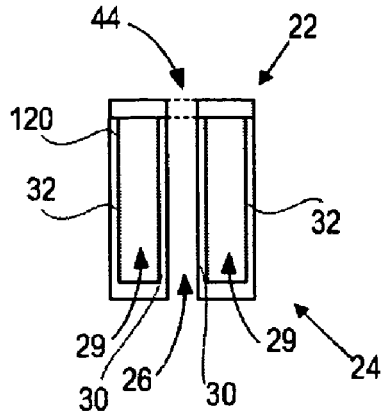
FIG. 12 is a cross-sectional view of the receptacle shown in FIG. 11.

Referring to FIGS. 1, 3, and 8, more specifically; a bag of bags 38 may be egressed from receptacle 20 and positioned upon plunging apparatus 10 such that bag 38 may in be in superimposition with plunger member 14. Further, bag 38 may cover plunger member 14, as shown in FIG. 10. As a result, any contaminated water positioned upon plunging apparatus 10, and more specifically, plunger member 14, may drip therefrom and into bag 38. As a result, any contaminated water that may drip from plunging apparatus 10, and more specifically, plunger member 14, onto the floor may be minimized, if not prevented, which is desirable Referring to FIGS. 11 and 12, in a further embodiment, receptacle 20 may be positioned at any position with respect to handle 12. More specifically, receptacle 20 may be positioned approximately mid-way with respect to first and second opposed ends of 16 and 18 of handle 12, shown as receptacle 120. To that end, second side 24 of receptacle 120 may comprise a third recess 44, with third recess 44 being in superimposition with first recess 26. Further, handle 12 may be positioned within first recess 26 and third recess 44.

Figure 13:
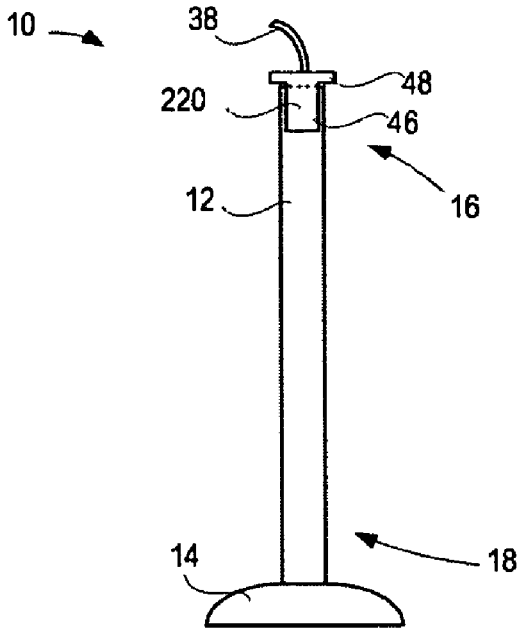
FIG. 13 is a perspective view of the plunging apparatus having a receptacle positioned therein, in a third embodiment of the present invention.

Referring to FIG. 13, in still a further embodiment, receptacle 20 may be positioned within handle 12 of plunging apparatus 10, shown as receptacle 220, with handle 12 being substantially hollow. Receptacle 220 may comprise a body 46 and a lip 48, with lip 48 coupled to body 46. Lip 48 may have a diameter greater than a diameter of handle 12 such that lip 46 may be positioned outside of handle 12. To that end, bags 38 may be egressed from receptacle 220 through throughway 40 in substantially the same method as described above.

The embodiments of the present invention described above are exemplary. Many changes and modifications may be made to the disclosure recited above, while remaining within the scope of the invention. Therefore, the scope of the invention should not be limited by the above description, but instead should be determined with reference to any appended claims along with their full scope of equivalents.

What is claimed is:

1. A plunging system comprising:

a plunger having a handle and a plunger member, said handle having first and second opposed ends with said plunger member being removably coupled to said second end of said handle; and a receptacle, having a top portion coupled to a body portion, said body portion including first and second support regions defining first and second recesses, said first support region completely cincturing said first recess, and said second support region completely cincturing said first support region and said first and second recesses, with a segment of said top portion in superimposition with said second recess defining a chamber for containing and dispensing one or more bags, with said receptacle being coupled to said first end of said handle, such that said handle is positioned within said first recess.

2. The system as recited in claim 1, wherein said receptacle is coupled to said handle by an adhesive.

3. The system as recited in claim 1, wherein said first recess has a diameter associated therewith, wherein said diameter is variable.

4. The system as recited in claim 1, wherein said receptacle comprises a bulbous portion coupled to said top portion.

5. The system as recited in claim 1, wherein said receptacle comprises a grip coupled to said body portion.

6. The system as recited in claim 1, wherein said chamber contains a plurality of bags, each of which is coupled to an adjacent bag of said plurality of bags.

7. The system as recited in claim 1, wherein said one or more bags is at least one of the following: scented, deodorized, sanitized, and absorbent.

8. The system as recited in claim 1, wherein said one or more bags comprise one or more handles, respectively.

9. The system as recited in claim 1, wherein said top portion of said receptacle is removably attached to said body portion.

10. A plunging system comprising:

a plunger having a handle and a plunger member, said handle having first and second opposed ends with said plunger member being removably coupled to said second end of said handle; and a receptacle, having a body portion, said body portion including first and second support regions defining first and second recesses, said first support region completely cincturing said first recess, and said second support region completely cincturing said first support region and said first and second recesses, said body portion being coupled to a top portion, said top portion including a third recess, with a segment of said top portion in superimposition with said second recess defining a chamber for containing and dispensing one or more bags, with said receptacle being coupled to said first end of said handle, such that said handle is positioned within said first and third recesses.

11. The system as recited in claim 10, wherein said receptacle is coupled to said handle by an adhesive.

12. The system as recited in claim 10, wherein said first and third recesses have a diameter associated therewith, wherein said diameter is variable.

13. The system as recited in claim 10, wherein said receptacle comprises a grip coupled to said body portion.

14. The system as recited in claim 10, wherein said chamber contains a plurality of bags, each of which is coupled to an adjacent bag of said plurality of bags.

15. The system as recited in claim 10, wherein said one or more bags is at least one of the following: scented, deodorized, sanitized, and absorbent.

16. The system as recited in claim 10, wherein said one or more bags comprise one or more handles, respectively.

17. The system as recited in claim 10, wherein said top portion of said receptacle is removably attached to said body portion.

* * * * *